United States Patent [19]

Rigby et al.

[11] Patent Number: 4,955,530

[45] Date of Patent: Sep. 11, 1990

[54] EASY OPENING LID FOR OVENABLE CARTON

[75] Inventors: William R. Rigby, Newark, Del.; Louis C. Woyce, Jr., Downingtown, Pa.

[73] Assignee: Westvaco Corporation, New York, N.Y.

[21] Appl. No.: 500,203

[22] Filed: Mar. 28, 1990

[51] Int. Cl.[5] ..... B65D 5/54

[52] U.S. Cl. ..... 229/123.2; 206/628; 229/125.35; 229/160.2

[58] Field of Search ..... 229/123.1, 123.2, 125.35, 229/160.2; 206/612, 626, 628

[56] References Cited

U.S. PATENT DOCUMENTS

| | | | |
|---|---|---|---|
| 2,990,948 | 7/1961 | Zackheim | 229/123.2 |
| 3,101,870 | 8/1963 | Betner | 206/628 |
| 3,244,356 | 4/1966 | Welowicz et al. | 206/628 |
| 3,454,210 | 7/1969 | Spiegel et al. | 229/123.1 |
| 3,550,835 | 12/1970 | Persson | 229/123.2 |
| 4,091,930 | 5/1978 | Buchner et al. | 229/123.2 |
| 4,312,451 | 1/1982 | Forbes, Jr. | 206/628 |
| 4,491,224 | 1/1985 | Horvath | 229/125.35 |
| 4,531,668 | 7/1985 | Forbes, Jr. | 206/612 |
| 4,871,071 | 10/1989 | Zimmermann | 206/628 |

*Primary Examiner*—Gary E. Elkins

[57] ABSTRACT

A paperboard lid for a tray type ovenable carton is provided with weakened score lines only in its lower surface to form an easy opening means. The lid includes a first continuous score line extending around the periphery of the lid and a second weakened score line of abbreviated length at one corner of the lid spaced from, but adjacent to, the first continuous score line. The lid preferably includes a right angle corner where the second weakened score line is located to provide a lift tab for venting the carton and for removing the lid to open the carton.

6 Claims, 2 Drawing Sheets

Fig 2.
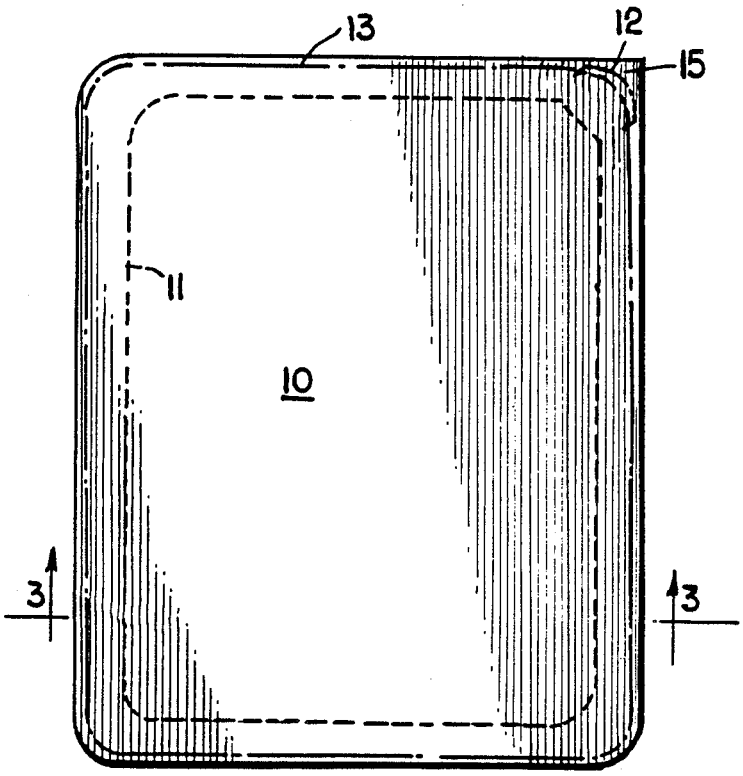
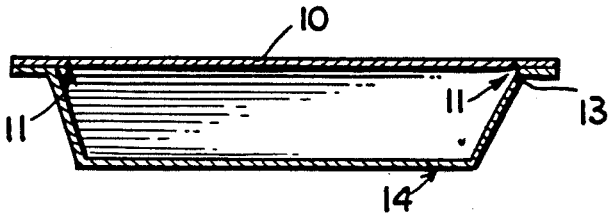
Fig 3.

EASY OPENING LID FOR OVENABLE CARTON

BACKGROUND OF THE INVENTION

The present invention relates to ovenable cartons prepared from paperboard, and more particularly to an easy opening lid for such a carton. The lid disclosed herein is particularly useful for tray type cartons, or cartons which include container trays having an upper integral flange. The lids of such cartons are glued or adhered to the flanges of the trays after filling, to close the cartons for shipment and storage. This step is usually accomplished with the use of a heat sealable coating applied to the inner surface of the lid and the inner surface of the tray including the flange. The coating also serves to make the paperboard waterproof and provides a food contact surface. However, when such cartons are heat sealed, the bond between the lid and flange areas of the tray is difficult to break. Thus, a variety of opening schemes have been proposed for such cartons including means for venting the cartons for cooking.

U.S. Pat. Nos. 4,312,451 and 4,531,668, owned by the present assignee herein, disclose two different schemes for opening cartons of the tray and lid type wherein the lids are heat sealed to tray flanges. In the '451 patent, a weakened score line is applied around the periphery of the lid where it is joined to the tray, or along the score line connecting the flange to the tray side walls, to produce a delamination area between the flange and the lid in the flange area when the opening tab is lifted. In the '668 patent, the lid includes a pair of continuous parallel weakened score lines, one on the inner surface of the lid, and another on the outer surface of the lid, each located inwardly from the periphery of the lid at distances spaced from the flange area of the tray. This produces a delamination area totally within the lid itself so as to leave portions of the lid still adhered to the tray flange for extra strength when the carton is opened. Meanwhile, U.S. Pat. No. 4,871,071 shows a venting and opening means for a lid integral with a flanged tray wherein the lid includes a combination of weakened score lines on the inner and outer surfaces of the lid at one corner. In the '071 patent and the '668 patent, the opening scheme requires that the lid be pushed inwardly at the corner to initiate the opening sequence. This action is not nearly as desireable as a lifting step to initiate the carton opening sequence.

Therefore, according to the present invention, a novel arrangement of weakened score lines are applied only to the inner surface of a paperboard lid to produce an easy opening means that permits the lid to be lifted away from the tray for venting and ultimately opening the carton.

SUMMARY OF THE INVENTION

According to the present invention, a paperboard lid is provided having at least one pair of side edges which meet at a ninety degree corner. The lid includes an upper surface and a lower surface wherein the improvement comprises first and second weakened score lines formed only in the lower surface of the lid to provide an easy opening means for the lid when it is heat sealed to the flanges of a tray type container. The first weakened score line is continuous and extends around the periphery of the lid following the general shape of the tray flange to which the lid is adhered, except at the ninety degree corner, where the weakened score line extends obliquely across the corner to define one boundary of an initial delamination area in the easy opening lid. The lid is preferably heat sealed about its periphery to the flange of a tray type container and the first continuous score line is preferably spaced inwardly from the outer peripheral edge of the lid a distance equal to or greater than the width of the tray flange especially in the region of the ninety degree corner where the initial delamination area is located. The second weakened score line is also located in the lower surface of the lid and is formed in the ninety degree corner of the lid where a lift tab is found. The second weakened score line forms a second boundary for the initial delamination area in the lid and includes a first segment which takes the general shape of the flange to which the lid is adhered, and a pair of second segments one located at each end of the first segment which project inwardly toward the ends of the oblique section of the first continuous weakened score line at the corner where the initial delamination area is found. The portion of the lid outside the second weakened score line around the periphery of the lid at the lift tab corner provides an extension which may be grasped for initially causing delamination to vent the container, and for subsequently removing the lid. The portion of the lid between the second weakened score line and the oblique portion of the first continuous weakened score line provides an initial delamination area when the lid extension is lifted to vent the container and for initiating complete delamination between the lid and tray flange for removing the lid.

The invention will be more clearly understood with reference to the following detailed description and drawings.

DESCRIPTION OF THE DRAWINGS

FIG. 2 is a top plan view of a carton including the lid of the present invention;

FIG. 3 is a cross sectional view of the carton of FIG. 2 taken along the lines 3—3.

DETAILED DESCRIPTION

Figure 1:
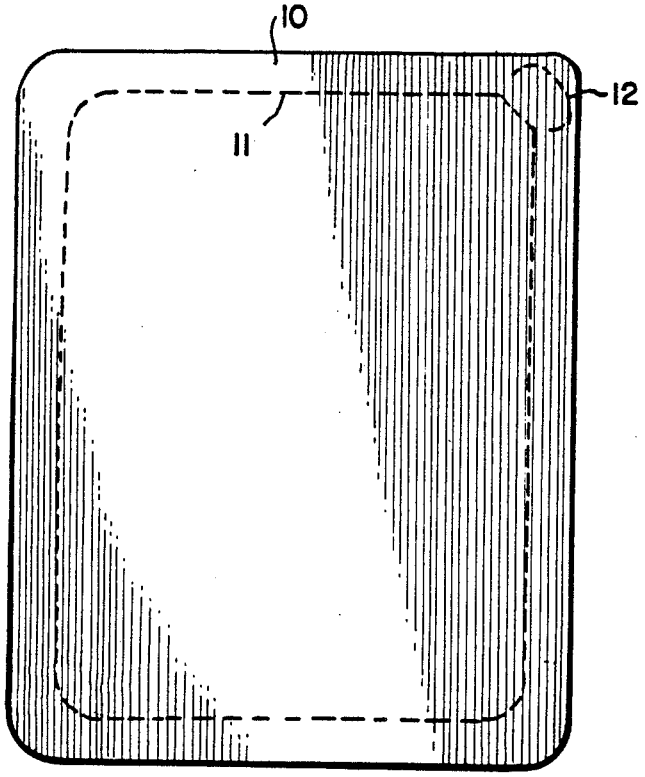
FIG. 1 is a top plan view of the lid of the present invention.

A preferred embodiment of the present invention is illustrated in FIG. 1 wherein there is shown a lid 10 which includes at least one ninety degree corner having first and second side edges. The remaining corners of the lid are generally shaped to match the corners of a typical flanged tray-type container. The upper surface of the lid 10 is printed in the usual course of business with graphics illustrating the contents of the container to which the lid is applied. Meanwhile the lower surface of the lid 10 is applied with first and second weakened score lines 11 and 12 to form the easy opening means of the present invention. The first weakened score line 11 is continuous around the periphery of the lid and follows the general peripheral shape of the tray flange of its intended tray except in the region of the ninety degree corner. Second weakened score line 12 is illustrated as generally arcuate in shape, but preferably follows the same general contour of the tray flange to which the lid is adhered.

Figure 4:
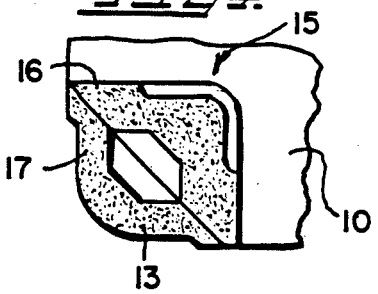
FIG. 4 is a partial plan view of one corner of the carton of FIG. 2 showing the lid partially opened to vent the carton.

More specifically, the first weakened score line 11 is located in the lower surface of the lid 10 at a distance from the edge of the lid that is equal to or greater than the width of the flange on the tray to which the lid is adhered. Thus, the first weakened score line 11 has a predetermined shape and location depending upon the size and shape of the tray flange to which the lid is adhered. The diagonal portion of score line 11 at the ninety degree corner of the lid 10 is also located inside the flange area of the attached tray and it cooperates with the second weakened score line 12 to provide an initial delamination area for venting and ultimately removing the lid. The second weakened score line 12 is located in the lower surface of the lid in the region outside the outer edge of the flange of the tray to which the lid is attached. Thus, the second weakened score line 12 has a predetermined shape and location depending upon the size and shape of the tray flange to which the lid is adhered. It includes a first segment in the same general shape as the tray flange and a pair of second segments, one located at each end of the first segment, which project inwardly toward the diagonal portion of the first weakened score line 11. By lifting the tab end 15 of lid 10 at the right angle corner of the lid, as shown in FIG. 4, an initial delamination of the adhered surfaces of the lid 10 and tray begins. Further lifting of the end 15 of lid 10 serves to completely remove the lid from the tray when it is desired to open the carton.

FIG. 2 illustrates the lid and tray combination with the outer edge of the tray flange 13 shown in phantom lines. FIG. 3 illustrates the tray 14 and lid 13 and shows the general location of the first weakened score line 11 in lid 10 with relation to the tray flange 13. The weakened score lines 11 and 12 are generally referred to in the trade as 50 percent cuts since they extend to a depth of about 50% of the thickness of the paperboard. The delamination area of the lid between the diagonal portion 16 of first weakened score line 11 and the second weakened score line 12 may be defined as a frangible corner panel. In the present invention, the frangible corner panel is disrupted by lifting the end portion 15 of lid 10 as opposed to the general prior art practice of depressing the corner panel. The present invention provides a more reliable and desireable method for venting and opening such cartons.

The present invention could readily be applied to lids with all corners being right angle corners. Such a lid might be used on a tray having a flange with all right angle corners. In such an instance, the second weakened score line would merely be designed to follow the general contour of the outside edge of the attached tray and would be located in the lid along or spaced slightly outwardly from the outside edge of the flange of the attached tray. Various other modifications of this invention will be apparent to those skilled in the art.

What is claimed is:

1. In combination, a paperboard lid having at least two adjacent side edges which meet at a ninety degree corner, an upper face and a lower face, and a tray having outwardly extending upper flanges to which the lid is adhered, the improvement comprising:

(a) a first continuous weakened score line extending around the periphery of the lid and located in the lower surface of the lid at a distance from the side edges thereof that is equal to or greater than the width of the flange of the tray to which the lid is adhered; and, (b) a second weakened score line formed in the lower surface of the lid at the ninety degree corner of the lid and located between the outer peripheral edge of the lid and the outer edge of the flange of the tray to which the lid is adhered.

2. The combination of claim 1 wherein the first weakened score line includes an oblique portion which extends diagonally across the ninety degree corner of the lid.

3. The combination of claim 2 wherein the second weakened score line includes a first segment of abbreviated length which follows the general contour of the outer edge of the flange of the tray to which the lid is adhered and a pair of second segments, one located at each end of the first segment, which project inwardly toward the oblique portion of the first weakened score line.

4. A paperboard lid having at least two adjacent side edges which meet at a corner of the lid, an upper face and a lower face, the improvement comprising:

(a) a first continuous weakened score line extending around the periphery of the lid, on the inner surface of the lid located inwardly from the outside edge by a predetermined distance, and including a portion which extends obliquely across a corner of the lid; and, (b) a second weakened score line of abbreviated length, on the inner surface of the lid, at said corner, said second weakened score line having a predetermined shape in the region of the corner terminating in segments which project inwardly toward the ends of the diagonal portion of the first weakened score line, said second weakened score line being located between the adjacent side edges of said corner of the lid and the diagonal portion of the first weakened score line by a predetermined distance.

5. The paperboard lid of claim 4 wherein said corner of the lid is a right angle corner.

6. The paperboard lid of claim 5 wherein the area between the diagonal portion of the first weakened score line and the second weakened score line provides an initial delamination area and a frangible corner panel.

* * * * *